US005775550A

United States Patent [19]

Toll

[11] Patent Number: 5,775,550

[45] Date of Patent: Jul. 7, 1998

[54] GRAVITY DISPENSER WITH IMPROVED SHUT-OFF FEATURE

[76] Inventor: Duncan M. Toll, 54 Cobbs Mill Rd., Wilton, Conn. 06897

[21] Appl. No.: 497,658

[22] Filed: Jun. 30, 1995

[51] Int. Cl.[6] ..... B67D 3/00

[52] U.S. Cl. ..... 222/481.5; 222/185.1; 222/519

[58] Field of Search ..... 222/129.1, 185.1, 222/481.5, 484, 519, 520, 521, 522, 547, 549, 564

[56] References Cited

U.S. PATENT DOCUMENTS

| | | | |
|---|---|---|---|
| 4,523,697 | 6/1985 | Jeans . | |
| 4,570,830 | 2/1986 | Jeans . | |
| 4,635,824 | 1/1987 | Gaunt et al. | 222/129.1 |
| 4,664,292 | 5/1987 | Jeans . | |
| 4,712,713 | 12/1987 | Karlis et al. | 222/3 |
| 4,804,112 | 2/1989 | Jeans | 222/129.1 |
| 4,804,117 | 2/1989 | Rudick | 222/214 |
| 5,118,010 | 6/1992 | Jeans | 222/3 |
| 5,211,314 | 5/1993 | Burrows | 222/185 |
| 5,251,789 | 10/1993 | Jeans | 222/129.1 |
| 5,323,832 | 6/1994 | Burrows | 222/481.5 |

FOREIGN PATENT DOCUMENTS

| | | | |
|---|---|---|---|
| 0 080 261 | 6/1983 | European Pat. Off. . | |
| 832616 | 9/1938 | France | 222/549 |
| 437007 | 8/1935 | United Kingdom | 222/549 |
| 471230 | 8/1937 | United Kingdom | 222/549 |

*Primary Examiner*—Philippe Derakshani
*Attorney, Agent, or Firm*—Kenyon & Kenyon

[57] ABSTRACT

The present invention relates to an improved gravity dispenser for dispensing, inter alia, a concentrate to be mixed with a diluent. The present invention includes a feature for reducing spray caused by closing of a flow control valve. A projection or ridge on a surface of one of the parts of the flow control valve, which projection or ridge can include bevelling or chamfering, sweeps across the area above the dispensing orifice, thereby directing a fluid shock wave away from the dispensing orifice. As a result, the fluid shock wave does not reach the dispensing orifice, thereby reducing or eliminating potential spray through the dispensing orifice.

11 Claims, 3 Drawing Sheets

GRAVITY DISPENSER WITH IMPROVED SHUT-OFF FEATURE

BACKGROUND OF THE INVENTION

1. Field of the Invention

The present invention relates to dispensers in general, and more particularly to an improved gravity dispenser for dispensing, inter alia, a concentrate to be mixed with a diluent. The present invention includes a feature for reducing spray caused by closing of a flow control valve.

2. Description of the Related Art

U.S. Pat. No. 4,570,830 describes a gravity dispenser device which allows controlled dispensing of a fluid, particularly a concentrate, at a predetermined flow rate. The flow rate of fluid out of a dispensing orifice is controlled by regulating the location of an air-egress point in the fluid container using a variable-position valve mechanism. Cutouts which define the air-egress points can be moved axially in the container, changing the pressure head to which the fluid at the dispensing orifice is subject. This variation in the pressure head thereby controls the flow rate of fluid from the container through the dispensing orifice.

The device of U.S. Pat. No. 4,570,830 contains mutually-coacting surfaces which are used to shut off the valve and prevent fluid dispensing. As shown in U.S. Pat. No. 4,570,830, an O-ring or an annular seal contacts one of the horizontal surfaces of the valve adjacent the dispensing orifice, to thereby effect shut-off. One disadvantage of the valve shut-off feature of the device shown in U.S. Pat. No. 4,570,830 is that as the mutually-coacting surfaces approach each other prior to shut-off, the volume of the area between the surfaces decreases, increasing the pressure of any fluid trapped between the two surfaces. This increasing fluid pressure results in a fluid shock wave which, when it enters the dispensing orifice, can cause undesirable spray at the dispensing orifice. Such spray is particularly disadvantageous when the fluid being dispensing is a potentially hazardous or caustic chemical concentrate.

SUMMARY OF THE INVENTION

It is an object of the present invention to provide a gravity dispenser with flow control which eliminates or reduces spray at shut-off. The object of the present invention is accomplished by including a raised projection or ridge on one of the two coacting surface which engage one another to provide shut-off at the dispensing orifice. This projection or ridge causes any fluid shock wave located between the coacting surfaces to be directed away from the projection or ridge as the coacting surfaces approach each other, thereby biasing the shock wave away from the dispensing orifice. The projection or ridge includes chamfering at its edges which also acts to reduce or eliminate spray by directing the fluid shock wave away from the dispensing orifice. As a result of these features, undesirable spray through the dispensing orifice at shut-off is reduced or eliminated.

DETAILED DESCRIPTION OF THE INVENTION

Figure 1:
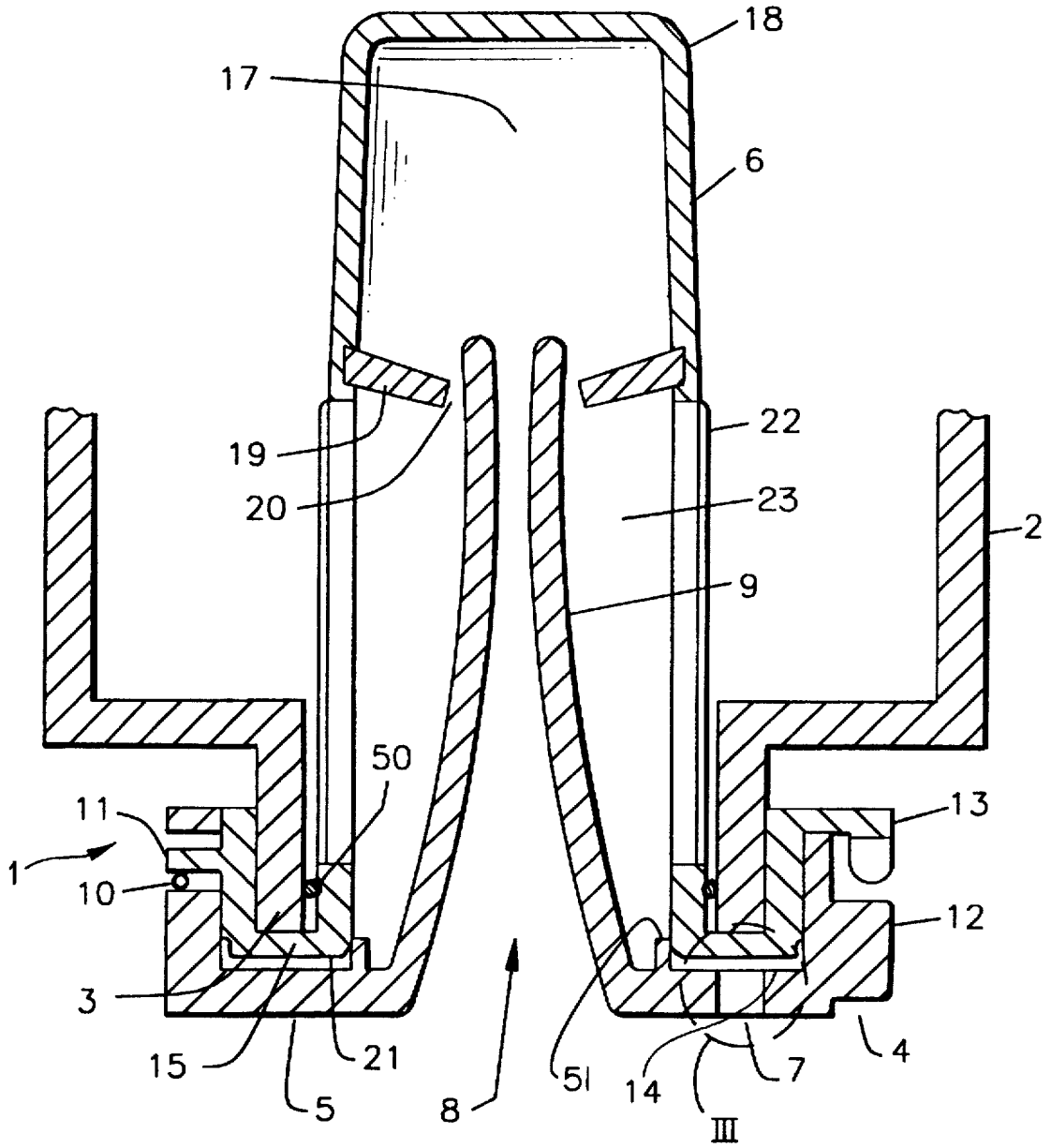
FIG. 1 is a cross-sectional side view of the gravity dispenser of the present invention.

The dispensing device 1 of the present invention includes a container 2 which holds, inter alia, a fluid concentrate. The container 2 includes an outlet end 3 into which is affixed a flow control valve 4 and is sealed at the top, such that entry of air into container 2 is only through the operation of the valve 4 described below. Flow control valve 4 includes two relatively-moving parts—a moving element 5 and a fixed element 6. Although moving element 5 and fixed element 6 are described below as being, respectively, fixed and movable, it is to be understood that relative movement between the two causes valve operation, and that therefore the "fixed" element could move while the "moving" element is fixed could be used to cause valve operation.

Moving element 5 includes a dispensing orifice 7 through which fluid within container 2 is dispensed. The dispensing orifice 7 is adjacent a lower horizontal surface 14. Moving element 5 also includes an air-inlet orifice 8 and an air inlet tube 9. Moving element 5 has on a radial periphery a series of slots 10 which cooperate with pegs 11 on fixed element 6 to allow moving element 5 to move axially relative to fixed element 6. Finally, moving element 5 includes a projection 12 which cooperates with a projection 13 on fixed element 6 to assist with relative movement of moving 5 and fixed 6 elements.

Fixed element 6 includes a lower portion 15 and an upper portion 16. Lower portion 15 includes pegs 11 which fit inside slots 10 on moving element 5 to allow moving element 5 to move rotationally as well as axially relative to fixed element 6. The slots 10 are generally sloped to thereby allow the pegs 11—and thereby the moving element 5—to move axially up and down as the moving element 5 is rotated relative to the fixed element 6. A projection 12 on moving element 5 can be engaged, either manually or automatically, to thereby rotate moving element 5 relative to fixed element 6. This rotational movement, in conjunction with the sloped shape of slots 10, causes axial movement of the moving element 5 relative to the fixed element 6.

Air inlet orifice 8 and air inlet tube 9 allow the ingress of air from the atmosphere into a chamber 17. Chamber 17 is formed by a cap 18 defining the upper portion 16 of fixed element 6. Cap 18 is connected to lower portion 15 by a series of stanchions 22 which form air egress slots 23 for egress of air into container 2. A baffle 19 secured to cap 18 forms the lower boundary of chamber 17. Air entering chamber 17 through air inlet orifice 8 and air inlet tube 9 passes into chamber 17 and exits chamber 17 through an air egress opening 20 between baffle 19 and air inlet tube 9. Air escaping from air egress opening 20 enters container 2.

Lower portion 15 of fixed element 6 includes an upper horizontal surface 21. Lower horizontal surface 14 and upper horizontal surface 21 cooperate to close dispensing orifice 7 when surfaces 14 and 21 contact one another. Contact of surfaces 14 and 21 is caused by axial movement of moving element 5 relative to fixed element 6 until such contact between surfaces 14 and 21 occurs. The resulting contact causes a seal between the surfaces 14, 21 such that fluid in container 2 cannot pass to dispensing orifice 7.

Fixed element may also include a seal element 50 in the form of an O-ring or the like, which seals the outlet end 3 of container 2 to the valve 4. A rim 51 can be used, with pins 11 and slots 12 to secure the fixed 6 and moving 5 elements to one another.

Figure 3:
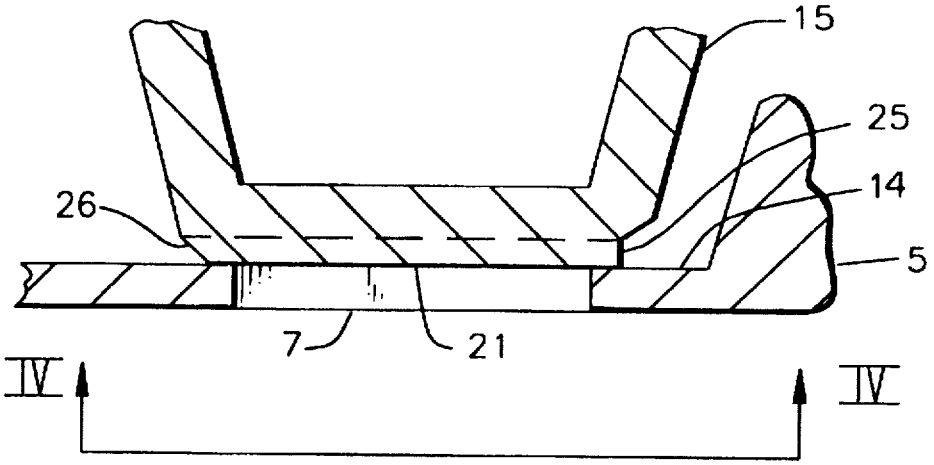
FIG. 3 is a detail, cross-sectional side view of the projection or ridge on the moving part.
Figure 4:
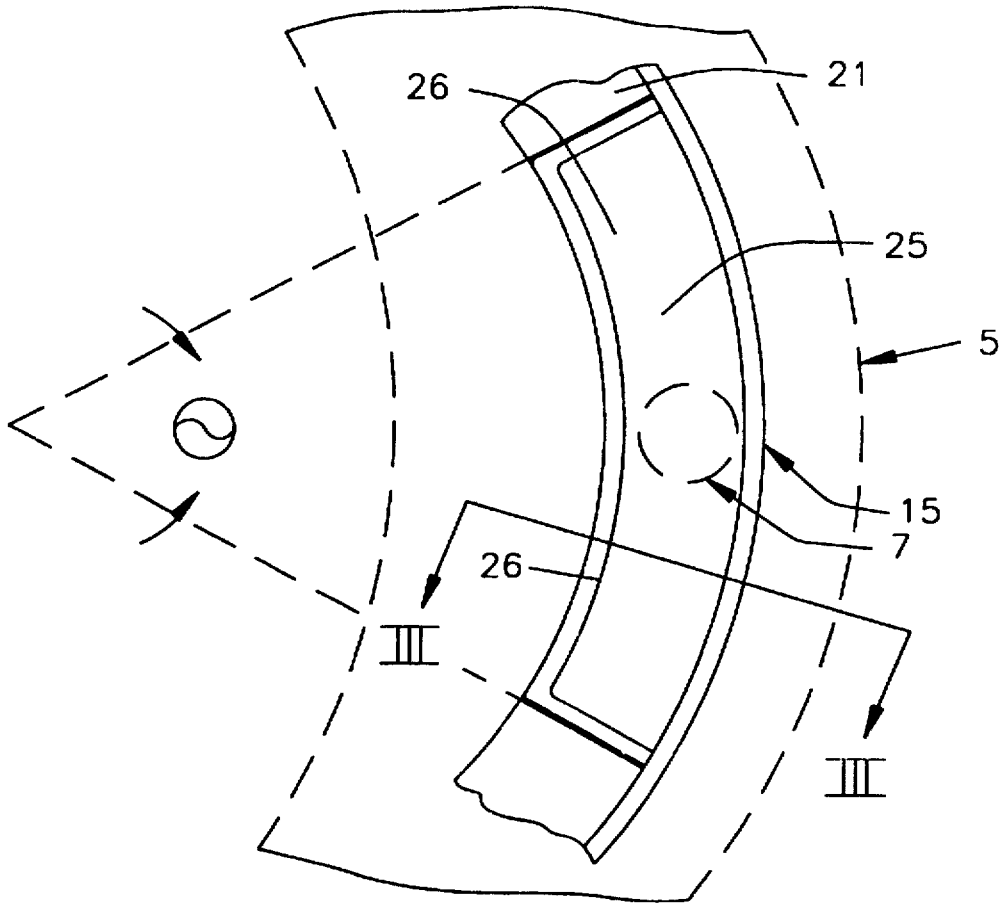
FIG. 4 is a detail bottom view of the projection or ridge on the moving part.

As shown particularly in FIGS. 3 and 4, upper horizontal surface 21 on fixed element 6 includes a projection or ridge 25. Projection or ridge 25 covers an arc θ of approximately 90° along the horizontal surface 21, and in the position in which surfaces 14 and 21 are contacting, the dispensing orifice 7 is approximately centered under the projection or ridge 25 (FIG. 4). Projection or ridge 25 includes a bevelled or chamfered edge 26.

Figure 2:
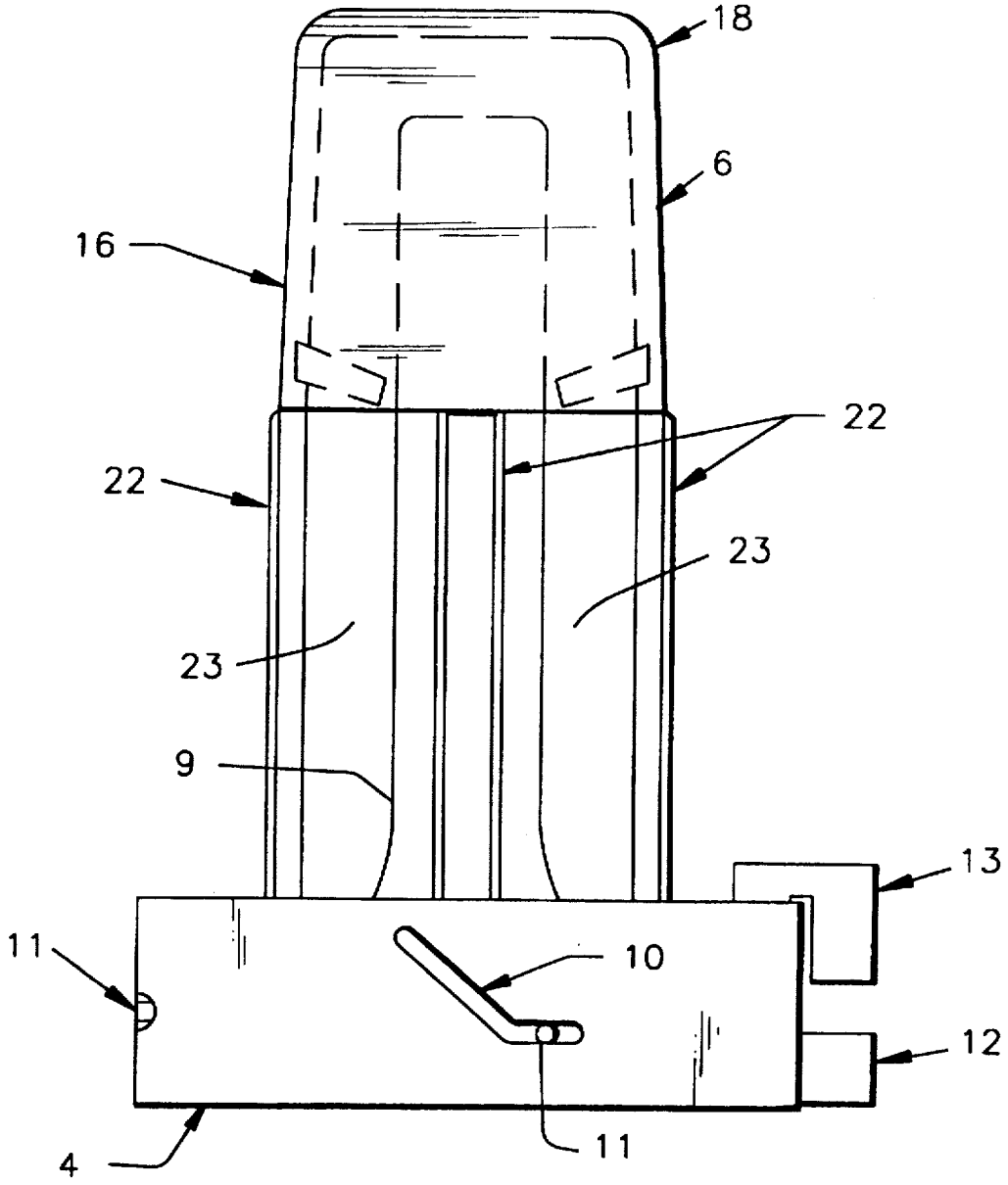
FIG. 2 is a side view of the gravity dispenser of the present invention.

In operation of the device of the present invention, tangential force applied to projection 12, in the direction into the paper in FIG. 2, causes moving element 5 to rotate, and because of the interaction between pegs 11 and slot 10, causes the surfaces 14 and 21 to move away from one another. This movement creates a space between the surfaces 14 and 21, allowing fluid to flow through the space and out dispensing orifice 7. Air enters the container 2 through the orifice 8, tube 9, chamber 17 and opening 20. The flow rate of liquid through dispensing orifice 7 is controlled by the height of the pressure head created in valve 4, which is in turn controlled by the inlet point of air into container 2 relative to the position of the dispensing orifice 7. As the dispensing orifice 7 moves away from the air egress point defined by the bottom of cap 18, the pressure head increases and the flow rate out dispensing orifice 7 increases.

Shut-off of the valve 4 proceeds as follows. Rotation of moving element 5 as the result of a tangential force applied to projection 12, in the direction out of the paper in FIG. 2, results in axial movement of surfaces 14 and 21 towards one another. This movement also causes projection or ridge 25 to sweep over the area above dispensing orifice 7. As the surfaces 14 and 21 move towards one another, a fluid shock wave is created in the space between these surfaces, which shock wave is pushed away from the area of the dispensing orifice 7 by the projection or ridge 25, including the bevelled or chamfered edge 26 of projection or ridge 25. As a result, the fluid shock wave does not approach dispensing orifice 7 as the surfaces 14 and 17 contact one another, thereby reducing or eliminating any spray out dispensing orifice 7 that would otherwise be caused by the shock wave reaching dispensing orifice 7.

The present invention contemplates a number of different variations on the above-described preferred embodiment. It is to be understood that the above description is only of one preferred embodiment, and that other valve designs may be used with the present invention, as well as other designs of the ridge or projection for reducing or eliminating spray. The scope of the invention is to be measured by the claims as set forth below.

I claim:

1. A flow control apparatus for use with a closed container, for controlling the dispensing of a fluid at a predetermined flow rate, comprising:

(a) a first part, the first part including a dispensing orifice and a first surface, the dispensing orifice adapted to be placed in communication with fluid contained within the container, the first part further comprising an air inlet orifice adapted to be placed in communication with the atmosphere; and (b) a second part, the second part forming a chamber, the chamber being in fluid communication with air inlet orifice and comprising an air outlet, the second part further comprising a second surface axially movable relative to the dispensing orifice, the second surface being located axially above the first surface, the first and second surfaces cooperating to close the dispensing orifice when the first and second surfaces contact one another, the second surface comprising a projection located in an area above the dispensing orifice.

2. The flow control apparatus of claim 1, wherein:

the surface is a horizontal surface.

3. The flow control apparatus of claim 1, wherein:

the first part comprises an air inlet tube in fluid communication with the air inlet orifice.

4. The flow control apparatus of claim 1, wherein:

the first part comprises at least one slot and the second part comprises at least one peg cooperating with the at least one slot.

5. The flow control apparatus of claim 4, wherein:

the at least one slot is sloped to allow relative axial movement between the first and second parts.

6. The flow control apparatus of claim 1, wherein:

the second part comprises a cap, the cap forming the chamber.

7. The flow control apparatus of claim 1, further comprising:

a seal element between the first part and an outlet end of the container.

8. The flow control apparatus of claim 7, wherein:

the seal element is an O-ring.

9. The flow control apparatus of claim 1, wherein:

the projection covers an arc along the surface.

10. The flow control apparatus of claim 9, wherein:

the arc is approximately 90°.

11. The flow control apparatus of claim 1, wherein:

the projection comprises a bevelled edge.

* * * * *